US011160715B2

(12) United States Patent
Wang et al.

(10) Patent No.: US 11,160,715 B2
(45) Date of Patent: Nov. 2, 2021

(54) SUPPORT REHABILITATION TRAINING ROBOT AND OPERATION METHOD THEREOF

(71) Applicant: Chunbao Wang, Guangdong (CN)

(72) Inventors: Chunbao Wang, Shenzhen (CN); Lihong Duan, Shenzhen (CN); Quanquan Liu, Shenzhen (CN); Yajing Shen, Shenzhen (CN); Wanfeng Shang, Shenzhen (CN); Zhuohua Lin, Shenzhen (CN); Tongyang Sun, Shenzhen (CN); Jinfeng Xia, Shenzhen (CN); Zhengdi Sun, Shenzhen (CN); Xiaojiao Chen, Shenzhen (CN); Weiguang Li, Shenzhen (CN); Zhengzhi Wu, Shenzhen (CN); Yulong Wang, Shenzhen (CN); Jianjun Long, Shenzhen (CN)

(73) Assignee: Chunbao Wang, Shenzhen (CN)

( * ) Notice: Subject to any disclaimer, the term of this patent is extended or adjusted under 35 U.S.C. 154(b) by 377 days.

(21) Appl. No.: 16/074,199

(22) PCT Filed: Feb. 28, 2017

(86) PCT No.: PCT/CN2017/075083

§ 371 (c)(1),
(2) Date: Jul. 31, 2018

(87) PCT Pub. No.: WO2018/014558

PCT Pub. Date: Jan. 25, 2018

(65) Prior Publication Data

US 2021/0137767 A1 May 13, 2021

(30) Foreign Application Priority Data

Jul. 18, 2016 (CN) ..... 201610564255.X
Jul. 18, 2016 (CN) ..... 201610564443.2
Jul. 18, 2016 (CN) ..... 201610564473.3

(51) Int. Cl.
*A61H 3/00* (2006.01)
*A61H 1/02* (2006.01)

(52) U.S. Cl.
CPC ..... *A61H 3/00* (2013.01); *A61H 1/0281* (2013.01); *A61H 2001/0211* (2013.01);
(Continued)

(58) Field of Classification Search
CPC A61H 1/0281; A61H 3/00; A61H 2001/0211; A61H 2003/007;
(Continued)

(56) References Cited

U.S. PATENT DOCUMENTS 6,821,233 B1 11/2004 Colombo et al.
7,125,388 B1 * 10/2006 Reinkensmeyer ..... A63B 69/0064 601/5

(Continued)

FOREIGN PATENT DOCUMENTS

CN 201005935 Y 1/2008
CN 101869526 A 10/2010

(Continued)

OTHER PUBLICATIONS

European Search Report in Application No. 17830206.3 dated Jul. 18, 2019.

(Continued)

*Primary Examiner* — Timothy A Stanis
(74) *Attorney, Agent, or Firm* — Maschoff Brennan

(57) ABSTRACT

Provided are a support rehabilitation training robot and an operation method thereof. The support rehabilitation training robot includes a crawler-type walking machine, a pedestal, a lifting lead screw mechanism, a manipulator and a (Continued)

counterweight mechanism. The manipulator includes a shoulder joint, a revolute joint, an elbow joint and a wrist joint. Each of the joints includes a motor, a harmonic reducer and an output terminal.

6 Claims, 2 Drawing Sheets

(52) U.S. Cl.
CPC ..... *A61H 2003/007* (2013.01); *A61H 2201/1207* (2013.01); *A61H 2201/14* (2013.01); *A61H 2201/165* (2013.01); *A61H 2201/1616* (2013.01); *A61H 2201/1638* (2013.01); *A61H 2201/1664* (2013.01); *A61H 2201/1671* (2013.01); *A61H 2203/0418* (2013.01)

(58) Field of Classification Search
CPC ..... A61H 2201/1207; A61H 2201/14; A61H 2201/1616; A61H 2201/1638; A61H 2201/165; A61H 2201/1664; A61H 2201/1671; A61H 2203/0418
See application file for complete search history.

(56) References Cited

U.S. PATENT DOCUMENTS 8,152,699 B1 * 4/2012 Ma ..... A63B 21/4011 482/69
9,981,157 B2 5/2018 Bayerlein et al.
2002/0026130 A1 2/2002 West
2004/0019304 A1 * 1/2004 West ..... A61H 1/0237 601/5
2008/0249438 A1 * 10/2008 Agrawal ..... A61H 1/0262 601/35
2012/0046578 A1 * 2/2012 Agrawal ..... A61H 3/008 601/35
2013/0137553 A1 5/2013 Kim et al.
2014/0100491 A1 * 4/2014 Hu ..... A63B 23/03541 601/27
2014/0228720 A1 * 8/2014 Kim ..... A61H 1/024 601/35
2015/0297934 A1 * 10/2015 Agrawal ..... A61H 1/0266 482/4
2018/0133088 A1 * 5/2018 Hou ..... A61H 3/00

FOREIGN PATENT DOCUMENTS

CN 102961231 A 3/2013
CN 104021704 A 9/2014
CN 104736207 A 6/2015
CN 204394934 U 6/2015
CN 104740830 A 7/2015
CN 104905940 A 9/2015
CN 105997437 A 10/2016
CN 106109183 A 11/2016
KR 10-20120129651 A 11/2012
WO 2016/021107 A1 11/2016

OTHER PUBLICATIONS

CN Office Action in Application No. 201610564443.2 dated Dec. 21, 2017.

* cited by examiner

SUPPORT REHABILITATION TRAINING ROBOT AND OPERATION METHOD THEREOF

TECHNICAL FIELD

The present disclosure belongs to the technical field of medical instruments, and in particular relates to a support rehabilitation training robot and an operation method thereof.

BACKGROUND

As China is gradually entering an aging society, the health of the elderly is increasingly attracting human attention. Stroke accounts for a large proportion of symptoms that pose a major threat to the health of the elderly. Therefore, rehabilitation therapy of stroke hemiplegia sequelae is particularly critical. For patients at late rehabilitation of hemiplegia, balance disturbance and hemiplegic gait are the principle problems, and thus attention should be paid to the training and correction of gait.

For traditional gait rehabilitation training, a therapist always plays a leading role. The therapist conducts the training by supporting the shoulder or hip of a patient by hand. Under a condition that training with quantitative time and intensity cannot be conducted, the degree of rehabilitation also varies depending on the personal experience of the therapist and the personal factors of the patient, which is not only a physical and mental test of the patient, but also a physical and mental test of the therapist. Existing gait training rehabilitation devices lay too much emphasis on walking training, while neglecting the physiological structure of the hip, the analysis and design cannot be done comprehensively for the kinematics of the hip, the effect of gait training is therefore limited.

SUMMARY

In the present disclosure, the physiological structure of a hip is analyzed, a support rehabilitation training robot and an operation method thereof are provided, so as to provide an efficient training platform for patient training.

A support rehabilitation training robot includes a crawler-type walking machine 1, a pedestal 2, a lifting lead screw mechanism, a manipulator, and a counterweight mechanism.

The lifting lead screw mechanism includes a guide rod 3, a lead screw 4, an arm lifting platform 8, and a lifting motor 24; the manipulator includes an arm connecting tube 11, a shoulder joint motor 12, an internal gear set 13, a shoulder-joint harmonic reducer 14, a revolute joint motor 15, an upper-arm supporting plate 16, a revolute-joint harmonic reducer 17, an elbow joint motor 18, an elbow-joint supporting plate 19, a bevel gear set 20, a wrist cardan joint 21, a forearm supporting plate 22, an elbow-joint harmonic reducer 23, a shoulder spring mounting block 25, an elbow spring mounting block 26, and an elbow-joint synchronous belt 27; and the counterweight mechanism includes a counterweight baseplate 5, a counterweight block 6, a guide bar 7, and a steel wire rope 9.

Further, the crawler-type walking machine 1 is fixed to the pedestal 2; the lifting mechanism is also fixed to the pedestal 2; the manipulator is fixed to the arm lifting platform 8 via the arm connecting tube 11, and the lead screw 4 rotates as driven by the lifting motor 24, so as to drive the arm lifting platform 8 to move up and down along the guide rod 3, thereby achieving supporting of a patient for squat rehabilitation training by the manipulator; and the counterweight mechanism is connected to the arm lifting platform 8 via the steel wire rope 9 and a pulley block 10.

Further, the manipulator is fixed to the arm connecting tube 11; the shoulder joint motor 12 is located in the arm connecting tube 11; the internal gear set 13, the shoulder-joint harmonic reducer 14 and the upper-arm supporting plate 16 are connected with each other; the shoulder spring mounting block 25 as an auxiliary support is fixed together with the upper-arm supporting plate 16; the shoulder spring connects the shoulder spring mounting block 25 and the shoulder supporting plate; and the shoulder joint motor 12 drives the upper arm to achieve forward bending and backward stretching motion around a shoulder joint.

The revolute joint motor 15 is fixed to the upper-arm supporting plate 16, the elbow-joint supporting plate 19 is driven by the revolute-joint harmonic reducer 17 to achieve internal-external rotation motion of an elbow joint around the upper arm.

The elbow joint motor 18 is fixed to the elbow-joint supporting plate 19, and a large pulley shaft is driven by the bevel gear set 20 and the elbow-joint synchronous belt 27; the elbow-joint harmonic reducer 23 is fixed to the large pulley shaft and is connected to the elbow spring mounting block 26 and the forearm supporting plate 22; and the elbow spring connects the elbow spring mounting block 26 and the elbow-joint supporting plate 19, thereby achieving stretching and bending motion of the forearm supporting plate 22 around the elbow joint.

Further, the counterweight mechanism is connected to the arm lifting platform 8 via the steel wire rope 9 and the pulley block 10, and provides a tensile force that acts on the entire platform by the counterweight block 6, thereby effectively achieving an effect of weight reduction.

Further, a lower body supporting manipulator and a lower body supporting lifting platform 7 are also included; the lower body supporting manipulator is fixed together with the lower body supporting lifting platform 7 via a lower-limb arm connecting tube 30; the lower body supporting manipulator includes: the lower-limb arm connecting tube 30, a lower-limb shoulder joint motor 31, a lower-limb shoulder supporting plate 32, a lower-limb shoulder spring mounting block 33, a lower-limb revolute joint motor 34, a lower-limb shoulder-joint harmonic reducer 35, a lower-limb internal gear set 36, a lower-limb revolute-joint harmonic reducer 37, a lower-limb elbow joint motor 38, a lower-limb elbow-joint supporting plate 39, a lower-limb bevel gear set 40, a lower-limb forearm supporting plate 41, a lower-limb wrist cardan joint 42, a lower-limb elbow spring mounting block 43, an exoskeleton harmonic reducer 44, a lower-limb elbow-joint harmonic reducer 45, an exoskeleton motor 46, an exoskeleton motor mounting plate 47, an exoskeleton synchronous belt 48, a lower-limb elbow-joint synchronous belt 49, and an exoskeleton synchronous belt cover plate 50; the counterweight mechanism is connected respectively to the upper body supporting lifting platform 12 and the lower body supporting lifting platform 7 via the steel wire rope 11 and the pulley block 14.

Further, the apparatus can achieve rehabilitation training of the human hip with three linear degrees of freedom and two rotational degrees of freedom during the gait training process, which highly simulates the physiological movement of the hip in the gait training and effectively enhances the effect of rehabilitation training.

A method for operating a support rehabilitation training robot includes the following steps:

Firstly, using a binding band to fix the shoulder of a trainee to the upper-limb wrist cardan joint 29 and fix a hip of the trainee to the lower-limb wrist cardan joint 42; and then fixing the exoskeleton synchronous belt cover plate 50 in a direction perpendicular to an upper leg.

During the gait training of the trainee, with cooperation of the crawler-type walking machine 1, the motor works under a torque mode: the shoulder joint motor drives the upper arm via the internal gear set and the shoulder-joint harmonic reducer to achieve the forward bending and backward stretching motion around the shoulder joint; the revolute joint motor drives the elbow-joint supporting plate via the revolute-joint harmonic reducer to achieve the internal-external rotation motion of the elbow joint around the upper arm; the elbow joint motor drives the forearm supporting plate via the bevel gear set and the elbow-joint synchronous belt to achieve the stretching and bending motion of the forearm around the elbow joint; and the exoskeleton motor 46 drives the exoskeleton motor mounting plate 47 via the exoskeleton synchronous belt 48 and the exoskeleton harmonic reducer 44 to achieve gait guiding motion guided by the exoskeleton synchronous belt cover plate 50.

Compared with the existing art, the present disclosure has beneficial effects described below.

Firstly, a combined motion of linear and rotational degrees of freedom is highly consistent with the physiological movement of human body in the gait training; secondly, the apparatus has a flexible degree of freedom and can highly simulate the operation of the therapist during the gait training; thirdly, each of the shoulder joint and the elbow joint is provided with a spring mounting block, such that part of the weight of the structure is counteracted by using the tensile force of the extended spring, and thus the design safety is high; fourthly, the integral weight reduction apparatus reduces loads of the patient and the motor; fifthly, the exoskeleton of the lower body supporting manipulator has a function of step guiding; and sixthly, the manipulator acts on both the upper and lower bodies, which is beneficial for maintaining body balance during the training.

Figure 1:
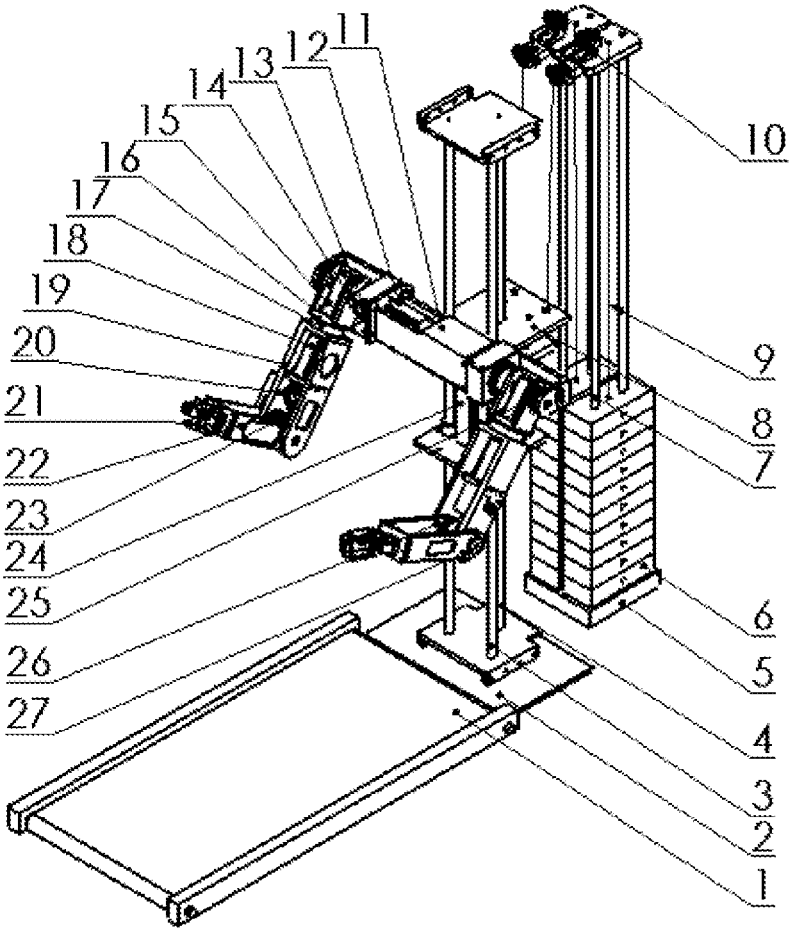
FIG. 1 is a structural schematic diagram of an embodiment of a support rehabilitation training robot of the present disclosure.
Figure 2:
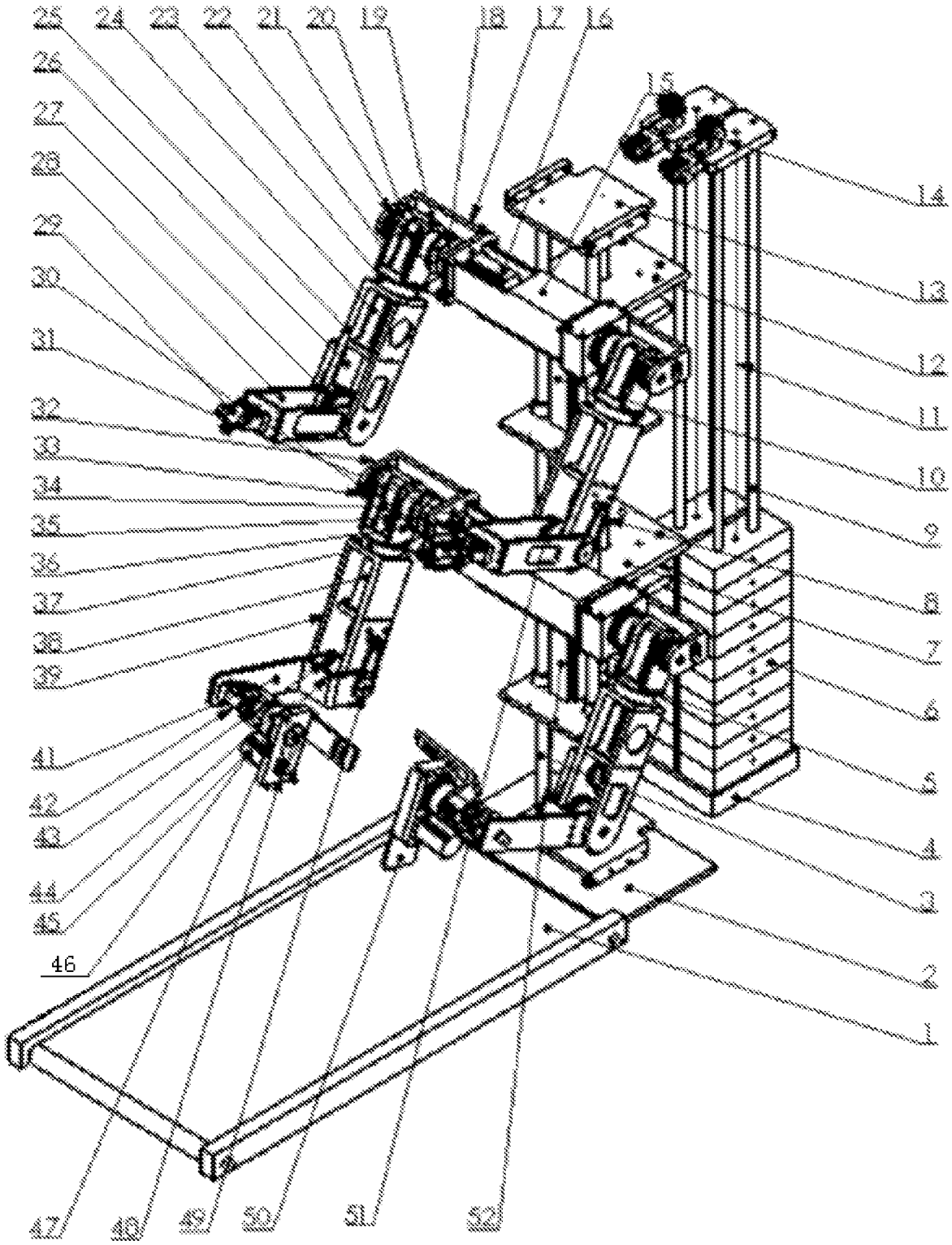
FIG. 2 is a structural schematic diagram of another embodiment of a support rehabilitation training robot of the present disclosure.

In the drawings: 1: crawler-type walking machine; 2: pedestal; 3: lead screw guide rod; 4: counterweight baseplate; 5: lead screw; 6: counterweight block; 7: lower body supporting lifting platform; 8: upper-limb elbow-joint synchronous belt; 9: guide bar; 10: upper lifting platform motor; 11: steel wire rope; 12: upper body supporting lifting platform; 13: lead screw top plate; 14: pulley block; 15: upper-limb arm connecting tube; 16: upper-limb shoulder joint motor; 17: upper-limb shoulder supporting plate; 18: upper-limb internal gear set; 19: upper-limb shoulder-joint harmonic reducer; 20: upper-limb revolute joint motor; 21: upper-limb shoulder spring mounting block; 22: upper-limb upper-arm supporting plate; 23: upper-limb revolute-joint harmonic reducer; 24: upper-limb elbow joint motor; 25: upper-limb elbow-joint supporting plate; 26: upper-limb bevel gear set; 27: upper-limb elbow-joint harmonic reducer; 28: upper-limb forearm supporting plate; 29: upper-limb wrist cardan joint; 30: lower-limb arm connecting tube; 31: lower-limb shoulder joint motor; 32: lower-limb shoulder supporting plate; 33: lower-limb shoulder spring mounting block; 34: lower-limb revolute joint motor; 35: lower-limb shoulder-joint harmonic reducer; 36: lower-limb internal gear set; 37: lower-limb revolute-joint harmonic reducer; 38: lower-limb elbow joint motor; 39: lower-limb elbow-joint supporting plate; 40: lower-limb bevel gear set; 41: lower-limb forearm supporting plate; 42: lower-limb wrist cardan joint; 43: lower-limb elbow spring mounting block; 44: exoskeleton harmonic reducer; 45: lower-limb elbow-joint harmonic reducer; 46: exoskeleton motor; 47: exoskeleton motor mounting plate; 48: exoskeleton synchronous belt; 49: lower-limb elbow-joint synchronous belt; 50: exoskeleton synchronous-belt cover plate; 51: upper-limb elbow spring mounting block; and 52: lower lifting platform motor.

DETAILED DESCRIPTION

The present disclosure will be further described below in detail with reference to the accompanying drawings and specific embodiments.

Referring to FIG. 1, a support rehabilitation training robot of an embodiment of the present disclosure includes a crawler-type walking machine 1, a pedestal 2, a lifting lead screw mechanism, a manipulator, and a counterweight mechanism.

The lifting lead screw mechanism includes a guide rod 3, a lead screw 4, an arm lifting platform 8, and a lifting motor 24. The manipulator includes an arm connecting tube 11, a shoulder joint motor 12, an internal gear set 13, a shoulder-joint harmonic reducer 14, a revolute joint motor 15, an upper-arm supporting plate 16, a revolute-joint harmonic reducer 17, an elbow joint motor 18, an elbow-joint supporting plate 19, a bevel gear set 20, a wrist cardan joint 21, a forearm supporting plate 22, an elbow-joint harmonic reducer 23, a shoulder spring mounting block 25, an elbow spring mounting block 26, and an elbow joint synchronous belt 27. The counterweight mechanism includes a counterweight baseplate 5, a counterweight block 6, a guide bar 7, and a steel wire rope 9.

Further, the crawler-type walking machine 1 is fixed to the pedestal 2. The lifting mechanism is also fixed to the pedestal 2. The manipulator is fixed to the arm lifting platform 8 via the arm connecting tube 11; the lead screw 4 rotates as driven by the lifting motor 24, so as to drive the arm lifting platform 8 to move up and down along the guide rod 3, thereby achieving supporting of a patient for squat rehabilitation training by the manipulator. The counterweight mechanism is connected to the arm lifting platform 8 via the steel wire rope 9 and a pulley block 10.

Further, the manipulator is fixed to the arm connecting tube 11. The shoulder joint motor 12 is located in the arm connecting tube 11. The internal gear set 13, the shoulder-joint harmonic reducer 14 and the upper-arm supporting plate 16 are connected with each other. The shoulder spring mounting block 25 as an auxiliary support is fixed together with the upper-arm supporting plate 16. The shoulder spring connects the shoulder spring mounting block 25 and the shoulder supporting plate; and the shoulder joint motor 12 drives the upper arm to achieve forward bending and backward stretching motion around a shoulder joint.

The revolute joint motor 15 is fixed to the upper-arm supporting plate 16, and the elbow-joint supporting plate 19 is driven by the revolute-joint harmonic reducer 17 to achieve internal-external rotation motion of an elbow joint around the upper arm.

The elbow joint motor 18 is fixed to the elbow-joint supporting plate 19; a big pulley shaft is driven by the bevel gear set 20 and the elbow-joint synchronous belt 27; the elbow-joint harmonic reducer 23 is fixed to the big pulley shaft and is connected to the elbow spring mounting block 26 and the forearm supporting plate 22; and the elbow spring connects the elbow spring mounting block 26 and the elbow-joint supporting plate 19, thereby achieving stretching and bending motion of the forearm supporting plate 22 around the elbow joint.

Further, the counterweight mechanism is connected to the arm lifting platform 8 via the steel wire rope 9 and the pulley block 10, and provides a tensile force that acts on the entire platform by the counterweight block 6, thereby effectively achieving an effect of weight reduction.

Further, a lower body supporting manipulator and a lower body supporting lifting platform 7 are also included. The lower body supporting manipulator is fixed together with the lower body supporting lifting platform 7 via a lower-limb arm connecting tube 30. The lower body supporting manipulator includes: the lower-limb arm connecting tube 30, a lower-limb shoulder joint motor 31, a lower-limb shoulder supporting plate 32, a lower-limb shoulder spring mounting block 33, a lower-limb revolute joint motor 34, a lower-limb shoulder-joint harmonic reducer 35, a lower-limb internal gear set 36, a lower-limb revolute-joint harmonic reducer 37, a lower-limb elbow joint motor 38, a lower-limb elbow-joint supporting plate 39, a lower-limb a bevel gear set 40, a lower-limb forearm supporting plate 41, a lower-limb wrist cardan joint 42, a lower-limb elbow spring mounting block 43, an exoskeleton harmonic reducer 44, a lower-limb elbow-joint harmonic reducer 45, an exoskeleton motor 46, an exoskeleton motor mounting plate 47, an exoskeleton synchronous belt 48, a lower-limb elbow-joint synchronous belt 49, and an exoskeleton synchronous belt cover plate 50. The counterweight mechanism is connected respectively to the upper body supporting lifting platform 12 and the lower body supporting lifting platform 7 via the steel wire rope 11 and the pulley block 14.

Further, the apparatus can achieve rehabilitation training of the human hip with three linear degrees of freedom and two rotational degrees of freedom during the gait training process, which highly simulates the physiological movement of the hip in the gait training and effectively enhances the effect of rehabilitation training.

A method for operating a support rehabilitation training robot includes the steps described below.

Firstly, a binding band is used for fixing the shoulder of a trainee to the upper-limb wrist cardan joint 29 and fixing the hip of the trainee to the lower-limb wrist cardan joint 42. Then, the exoskeleton synchronous belt cover plate 50 in a direction perpendicular is fixed to an upper leg.

During the gait training of the trainee, with cooperation of the crawler-type walking machine 1, the motor works under a torque mode: the shoulder joint motor drives the upper arm via the internal gear set and the shoulder-joint harmonic reducer to achieve the forward bending and backward stretching motion around the shoulder joint; the revolute joint motor drives the elbow-joint supporting plate via the revolute-joint harmonic reducer to achieve the internal-external rotation motion of the elbow joint around the upper arm; the elbow joint motor drives the forearm supporting plate via the bevel gear set and the elbow-joint synchronous belt to achieve the stretching and bending motion of the forearm around the elbow joint; and the exoskeleton motor 46 drives the exoskeleton motor mounting plate 47 via the exoskeleton synchronous belt 48 and the exoskeleton harmonic reducer 44 to achieve gait guiding motion guided by the exoskeleton synchronous belt cover plate 50.

What is claimed is:

1. A support rehabilitation training robot, comprising:

a crawler-type walking machine, a pedestal, and a lifting lead screw mechanism, a manipulator, and a counterweight mechanism, wherein:

the lifting lead screw mechanism comprises a guide rod, a lead screw, an arm lifting platform, and a lifting motor;

the manipulator comprises an arm connecting tube, a shoulder joint motor, an internal gear set, a shoulder-joint harmonic reducer, a revolute joint motor, an upper-arm supporting plate, a revolute-joint harmonic reducer, an elbow joint motor, an elbow-joint supporting plate, a bevel gear set, a wrist cardan joint, a forearm supporting plate, an elbow-joint harmonic reducer, a shoulder spring mounting block, an elbow spring mounting block, and an elbow-joint synchronous belt; and the counterweight mechanism comprises a counterweight baseplate, a counterweight block, a guide bar, and a steel wire rope.

2. The support rehabilitation training robot according to claim 1, wherein:

the crawler-type walking machine is fixed to the pedestal;

the lifting lead screw mechanism is also fixed to the pedestal; the manipulator is fixed to the arm lifting platform via the arm connecting tube, and the lead screw is configured to rotate as driven by the lifting motor, so as to drive the arm lifting platform to move up and down along the guide rod, thereby achieving supporting of a patient for squat rehabilitation training by the manipulator; and the counterweight mechanism is connected to the arm lifting platform via the steel wire rope and a pulley block.

3. The support rehabilitation training robot according to claim 1, wherein:

the shoulder joint motor is located in the arm connecting tube; the internal gear set, the shoulder-joint harmonic reducer and the upper-arm supporting plate are connected with each other; the shoulder spring mounting block as an auxiliary support is fixed together with the upper-arm supporting plate; and the shoulder joint motor is configured to drives an upper arm to achieve forward bending and backward stretching motion around a shoulder joint;

the revolute joint motor is fixed to the upper-arm supporting plate, the elbow-joint supporting plate is configured to be driven by the revolute-joint harmonic reducer to achieve internal-external rotation motion of an elbow joint around the upper arm; and the elbow joint motor is fixed to the elbow-joint supporting plate.

4. The support rehabilitation training robot according to claim 1, wherein:

the support rehabilitation training robot further comprises a lower body supporting lifting platform and a lower body supporting manipulator;

the lower body supporting manipulator comprises: a lower-limb arm connecting tube, a lower-limb shoulder joint motor, a lower-limb shoulder supporting plate, a lower-limb shoulder spring mounting block, a lower-limb revolute joint motor, a lower-limb shoulder-joint harmonic reducer, a lower-limb internal gear set, a lower-limb revolute-joint harmonic reducer, a lower-limb elbow joint motor, a lower-limb elbow-joint supporting plate, a lower-limb bevel gear set, a lower-limb forearm supporting plate, a lower-limb wrist cardan joint, a lower-limb elbow spring mounting block, an exoskeleton harmonic reducer, a lower-limb elbow-joint harmonic reducer, an exoskeleton motor, an exoskeleton motor mounting plate, an exoskeleton synchronous belt, a lower-limb elbow-joint synchronous belt, and an exoskeleton synchronous belt cover plate; and the lower body supporting manipulator is fixed together with the lower body supporting lifting platform via the lower-limb arm connecting tube; an upper lifting platform motor and a lower lifting platform motor are configured to drive an upper body supporting lifting platform and the lower body supporting lifting platform to move up and down along a lead screw guide rod, thereby achieving supporting of a patient for squat rehabilitation training by the lower body supporting manipulator; and the counterweight mechanism is connected respectively to the upper body supporting lifting platform and the lower body supporting lifting platform via the steel wire rope and a pulley block.

5. The support rehabilitation training robot according to claim 4, wherein the counterweight mechanism is connected to the upper body supporting lifting platform and the lower body supporting lifting platform respectively via the steel wire rope and the pulley block, and provides a tensile force through the counterweight block.

6. A method for operating a support rehabilitation training robot, wherein:

the support rehabilitation training robot comprises a crawler-type walking machine, a pedestal, a lifting lead screw mechanism, a manipulator, and a counterweight mechanism;

the lifting lead screw mechanism comprises a guide rod, a lead screw, an arm lifting platform, and a lifting motor;

the manipulator comprises an arm connecting tube, a shoulder joint motor, an internal gear set, a shoulder-joint harmonic reducer, a revolute joint motor, an upper-arm supporting plate, a revolute-joint harmonic reducer, an elbow joint motor, an elbow-joint supporting plate, a bevel gear set, an upper-limb wrist cardan joint, a forearm supporting plate, an elbow-joint harmonic reducer, a shoulder spring mounting block, an elbow spring mounting block, and an elbow-joint synchronous belt;

the counterweight mechanism comprises a counterweight baseplate, a counterweight block, a guide bar, and a steel wire rope; and the method comprises:

using a binding band to fix the shoulder of a trainee to the upper-limb wrist cardan joint and fix a hip of the trainee to a lower-limb wrist cardan joint; and fixing an exoskeleton synchronous belt cover plate in a direction perpendicular to an upper leg, wherein:

during gait training of the trainee, with cooperation of the crawler-type walking machine, a motor works under a torque mode;

the shoulder joint motor drives an upper arm via the internal gear set and the shoulder-joint harmonic reducer to achieve forward bending and backward stretching motion around the shoulder joint;

the revolute joint motor drives the elbow-joint supporting plate via the revolute-joint harmonic reducer to achieve internal-external rotation motion of the elbow joint around the upper arm;

the elbow joint motor drives the forearm supporting plate via the bevel gear set and the elbow-joint synchronous belt to achieve the stretching and bending motion of the forearm around the elbow joint; and an exoskeleton motor drives an exoskeleton motor mounting plate via an exoskeleton synchronous belt and an exoskeleton harmonic reducer to achieve gait guiding motion guided by an exoskeleton synchronous belt cover plate.

* * * * *